US009220305B2

(12) United States Patent
Hersh

(10) Patent No.: US 9,220,305 B2
(45) **Date of Patent: *Dec. 29, 2015**

(54) CONVERTIBLE SWIMWEAR

(71) Applicant: Stephanie Hersh, Lake Worth, FL (US)

(72) Inventor: Stephanie Hersh, Lake Worth, FL (US)

( * ) Notice: Subject to any disclaimer, the term of this patent is extended or adjusted under 35 U.S.C. 154(b) by 149 days.

This patent is subject to a terminal disclaimer.

(21) Appl. No.: 13/668,565

(22) Filed: Nov. 5, 2012

(65) Prior Publication Data

US 2013/0059498 A1 Mar. 7, 2013

Related U.S. Application Data

(60) Continuation-in-part of application No. 13/242,814, filed on Sep. 23, 2011, now Pat. No. 8,316,464, which is a division of application No. 12/206,875, filed on Sep. 9, 2008, now Pat. No. 8,051,496.

(51) Int. Cl.
*A41D 7/00* (2006.01)
*A41D 15/00* (2006.01)

(52) U.S. Cl.
CPC .. *A41D 7/00* (2013.01); *A41D 15/00* (2013.01)

(58) Field of Classification Search
CPC ..... A41D 7/00; A41D 7/001; A41D 7/003; A41D 7/005; A41D 15/00; A41F 5/00; A41F 7/00; A41B 1/06
USPC ..... 2/67, 71, 72, 402, 104; 450/6, 5, 26, 28, 450/30, 31, 33, 149
See application file for complete search history.

(56) References Cited

U.S. PATENT DOCUMENTS

| | | | | | |
|---|---|---|---|---|---|
| 2,038,301 | A | * | 4/1936 | Levi | 2/67 |
| 2,060,689 | A | * | 11/1936 | Read | 2/67 |
| 2,183,380 | A | * | 12/1939 | Hurt | 2/67 |
| 2,341,596 | A | * | 2/1944 | Cobb | 2/67 |
| 2,429,767 | A | * | 10/1947 | Oliensis | 450/7 |
| 2,715,225 | A | * | 8/1955 | Gould | 450/58 |
| 3,002,193 | A | * | 10/1961 | Briskman | 2/72 |
| 3,106,717 | A | * | 10/1963 | Cuvin | 2/70 |
| 3,961,376 | A | * | 6/1976 | Howell | 2/71 |
| 4,154,249 | A | * | 5/1979 | Darring | 450/14 |
| 4,301,545 | A | | 11/1981 | Camarena | |
| 4,414,691 | A | * | 11/1983 | Estruch | 2/67 |
| 4,656,669 | A | | 4/1987 | Beard | |
| 4,815,145 | A | | 3/1989 | Chow | |
| 4,853,977 | A | | 8/1989 | Foreman | |
| RE33,406 | E | * | 10/1990 | Wior | 2/67 |
| 4,999,848 | A | | 3/1991 | Oney | |
| 5,163,182 | A | | 11/1992 | Fiveash | |
| 5,331,685 | A | | 7/1994 | Belgard | |
| 5,398,343 | A | | 3/1995 | Kuracina | |
| 5,518,798 | A | | 5/1996 | Riedel | |
| 5,894,600 | A | | 4/1999 | Chenefront | |

(Continued)

*Primary Examiner* — Alissa L Hoey
(74) *Attorney, Agent, or Firm* — McHale & Slavin, P.A.

(57) ABSTRACT

Convertible swimwear comprising a top piece and extendable bottom piece. The bottom piece having an intermediate portion with an upper edge that can be positioned adjacent to a lower edge of top piece and held in position by an elastic strap. The upper edge of the intermediate section includes an elastic strap to maintain the upper edge in position to form a one piece bathing suit. The top piece may further include a cover flap to conceal the edge of the intermediate section for a seamless appearance. The upper edge of the intermediate section can be rolled, folded or scrunched toward the bottom piece to effectively convert the one piece style bathing suit to a two piece style bathing suit.

7 Claims, 3 Drawing Sheets

(56) References Cited

U.S. PATENT DOCUMENTS

| | | | | |
|---|---|---|---|---|
| 6,009,556 | A | 1/2000 | Nenninger | |
| 6,016,569 | A | 1/2000 | Everett et al. | |
| 6,035,439 | A | 3/2000 | Chin | |
| 6,083,079 | A * | 7/2000 | Pearson | 450/1 |
| 6,185,741 | B1 | 2/2001 | Kehoe | |
| 6,223,352 | B1 | 5/2001 | Watlington | |
| 6,240,560 | B1 | 6/2001 | DeCaro | |
| 6,792,620 | B2 * | 9/2004 | Green | 2/69 |
| 6,811,462 | B1 * | 11/2004 | Kenneally | 450/30 |
| 7,077,720 | B2 | 7/2006 | Schneider et al. | |
| 7,168,096 | B1 * | 1/2007 | Landa et al. | 2/67 |
| 7,181,773 | B1 | 2/2007 | Piraka | |
| 7,210,170 | B2 * | 5/2007 | Lee | 2/67 |
| D544,678 | S | 6/2007 | Fitzgerald | |
| 7,260,852 | B2 | 8/2007 | Sheetz | |
| 7,340,780 | B2 | 3/2008 | Levy | |
| 7,407,430 | B1 * | 8/2008 | Wanzenbock et al. | 450/63 |
| 8,051,496 | B2 | 11/2011 | Hersh | |
| 8,316,464 | B2 | 11/2012 | Hersh | |
| 8,522,362 | B1 * | 9/2013 | Stones et al. | 2/67 |
| 2002/0042937 | A1 * | 4/2002 | Green | 2/69 |
| 2006/0031976 | A1 | 2/2006 | Nwawka | |
| 2006/0037123 | A1 * | 2/2006 | Green | 2/69 |
| 2009/0094723 | A1 * | 4/2009 | Doda, Jr. | 2/67 |
| 2009/0126072 | A1 * | 5/2009 | Allen | 2/82 |
| 2011/0289646 | A1 * | 12/2011 | Scozzafava | 2/67 |

* cited by examiner

CONVERTIBLE SWIMWEAR

CROSS REFERENCE TO RELATED APPLICATIONS

In accordance with 37 C.F.R. 1.76, a claim of priority is included in an Application Data Sheet filed concurrently herewith. Accordingly, under 35 U.S.C. §119(e), 120, 121, and/or 365(c) the present invention claims priority, as a continuation-in-part of U.S. patent application Ser. No. 13/242,814, filed Sep. 23, 2011, entitled "CONVERTIBLE SWIMWEAR", which is a divisional of U.S. patent application Ser. No. 12/206,875, filed Sep. 9, 2008, which is now U.S. Pat. No. 8,051,496, issued Nov. 8, 2011, entitled "CONVERTIBLE SWIMWEAR". The contents of which the above referenced applications are incorporated herein by reference.

FIELD OF THE INVENTION

This invention relates generally to bathing garments and, more particularly, to convertible swimwear capable of converting from a one piece swimsuit to a two piece swimsuit.

BACKGROUND OF THE INVENTION

Women's swimwear has evolved over time. While women's swimwear may have originated for use in bathing spas, swimwear is now used for sunbathing as well as swimming. Starting with bloomers and stockings, swimwear migrated into one piece style bathing suits. The one piece style bathing suits became the generally accepted swimwear and thereafter began a trend of creating swimwear that was lighter and briefer. The desire for greater exposure while wearing swimwear created the two piece style bathing suits.

Two piece bathing suits, also known as bikinis, allow women to have more of their bodies exposed for tanning purposes and/or to further highlight their figure. Unfortunately, bikinis expose so much skin that a woman can easily sunburn. For instance, a two piece bathing suit that reveals the woman's stomach may not be suitable for certain activities since it offers little coverage of the women's body.

There have been various attempts to design swimwear which is interchangeable from a one piece to a two piece style bathing suit which combine fashion and function. For instance, U.S. Pat. No. 4,301,545, "Adjustable Swimsuit" includes an adjustable swimsuit comprising an upper piece and a lower piece, the upper piece including a pair of cups and an intermediate connector section between the cups, with the connector including a first connector component. The lower piece includes a connector member with a second connecting component for connection to the first connecting component. The first connector component and the second connector member are fastened to one another in an adjustable fashion using string or ribbon, and the upper piece connecting section and lower piece connecting member are configured to cover selected portions of the wearer's body when the first connector component and the second connector component are connected to one another. The connecting components are concealable in the upper and lower pieces of the bathing suit, respectively, when not in use. The connecting components are tucked into the swimsuit's upper and lower piece when the wearer desires to wear a two piece swimsuit. However, because the lower and upper pieces are fitted against the wearer's skin when the wearer tucks in the respective connecting component within its respective piece it protrudes outwardly creating an unfashionable look and furthermore it may also be uncomfortable for the wearer as a connecting component is pressed up against the wearer's skin by the tight-fitting upper and lower pieces.

U.S. Pat. No. 4,656,669, "Versatile Bathing Suit" provides a two-piece bathing suit having an upper bra section and a lower panty section. The panty section comprises at least one pouch disposed in an internal area of the panty. The pouch can contain various bathing suit materials for complementing the bathing suit ensemble. One such material is a frontal piece for covering the abdomen. This piece attaches underneath the bra and panty sections, and effectively converts the two-piece appearance into a one-piece look. Unfortunately, this extra material portion must be inconveniently carried by the wearer at all times that the swimsuit is in a two piece style bathing suit.

U.S. Pat. No. 4,815,145, "Convertible Bathing Suit" comprising a top portion having securing means disposed along at least a portion of the lower edge thereof; a bottom portion having securing means secured along at least a portion of the upper edge thereof; and a midriff portion having securing means disposed along at least a portion of its upper and lower edges corresponding to the securing means of said top portion and bottom portion, respectively, whereby the upper edge of said midriff portion can be attached to the lower edge of said top portion, and the lower edge of said midriff portion can be attached to the upper edge of said bottom portion to form a one-piece style bathing suit or said midriff portion can be detached from said top portion and said bottom portion to form a two piece type bathing suit. Again, this extra material portion must be inconveniently carried by the wearer at all times that the swimsuit is in a two piece style bathing suit.

U.S. Pat. No. 5,518,798 discloses an elastic bathing wear garment knitted from a net like fabric that reduces the amount of incident UV radiation to pass.

U.S. Pat. No. 6,223,352 discloses an adjustable clothing ensemble for an infant wherein a bottom portion of a garment is securable to an upper portion by use of fasteners such that the length of the ensemble may be adjusted.

U.S. Pat. No. 6,185,741 B1, "Convertible Ladies Swimwear" provides a convertible ladies' swimsuit that can be changed from a one piece swimsuit into either a two piece tank-top style swimsuit or two piece bikini style swimsuit for purposes such as, but not limited to, tanning or using the restroom. The swimsuit has a top piece and a separate bottom piece that may be attached to each other along the top edge of the bottom piece and the bottom edge of the top piece, using any of a number of attachment or fastening means such as snaps, Velcro® (hook and loop components), or any other appropriate fastening means, to form a one piece swimsuit. The top piece can be unfastened from the bottom piece to allow the wearer to conveniently use the bathroom. The lower region of the top piece can also be unfastened from the bottom piece, folded upward, either under or over the lower region of the top piece, and fastened behind the wearer's back to create a tank top style or a bikini type two piece swimsuit. The lower region of the top piece can alternatively be folded up completely over the front of the swimsuit and secured behind the wearer's neck to create a bikini style swimsuit, which allows for complete sunning of the midriff. Unfortunately, the extra material portion is either tucked into the top piece creating an unfashionable look or it is fastened behind the wearer's back or neck in effect creating less area of exposure for tanning purposes which the two piece attempts to accomplish.

While these prior arts may be suitable for the particular purpose to which they address, these prior arts would not be suitable for the purposes of the present invention as heretofore described. Alleviating the existing problems of having to retain and carry a midriff portion when not using the swimsuit as a one piece style or not having an unsightly, unfashionable connecting component protruding from the inside of the lower or upper piece of a two style bathing suit when tucked into its respective piece. As a consequence of these aforementioned problems, it is an objective of the present invention to provide a convertible swimwear having removably attachable top and bottom piece for converting the swimwear from a one piece to a two piece style bathing suit that is fashionable and functional.

SUMMARY OF THE INVENTION

Disclosed is a convertible swimwear ensemble comprising a top piece having at least one strap for securing the top piece to the body, and a bottom piece having an intermediate section that extends upward from the bottom piece. An upper edge of the intermediate section is positioned adjacent to a lower edge of the top piece wherein the top and bottom piece provide the appearance of a one piece bathing suit. The intermediate section includes at least one elastic based strap formed the upper edge for maintaining the intermediate section in position during normal use. The intermediate section can then be folded, rolled or scrunched together wherein the intermediate section strap is use to maintain the intermediate section in the folded, rolled or scrunched position thereby providing the appearance of a two piece style bathing suit.

Accordingly, it is an objective of the present invention to provide convertible swimwear that is convertible between a piece and two piece style bathing suit.

It is a further objective of the present invention to provide convertible swimwear where the upper edge of the intermediate section can be concealed by the use of a material cover flap that extends beneath the top piece.

It is additional objective of the present invention to provide convertible swimwear where the upper edge of the intermediate portion can be rolled, folded, or scrunched relative to the bottom piece and then secured in position by an elastic component.

It is an objective of the present invention to provide convertible swimwear wherein the intermediate portion of the bottom piece is capable of covering the entire abdomen of a wearer's body to conceal the skin from sunlight.

It is an objective of the present invention to provide convertible swimwear wherein the intermediate portion of the bottom piece is capable of covering the back of a wearer's body.

It is a further objective of the present invention to provide convertible swimwear where the suit may be formed into either a high cut or low cut bathing suit.

It is a further objective of the present invention to provide convertible swimwear constructed of an elastic based water porous material.

Other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
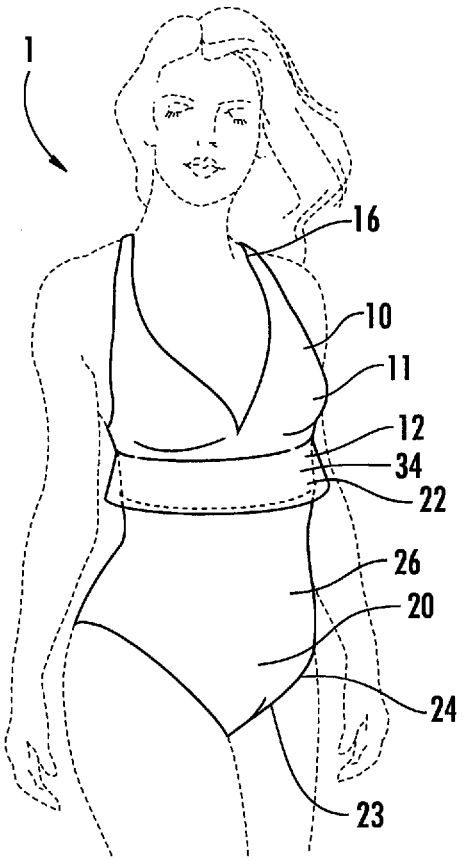
FIG. 1 is a front view of the convertible swimwear.

A detailed embodiment of the instant invention is disclosed herein, however, it is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

Referring now to the Figures, the convertible swimwear 1 is constructed of expandable or elastic material allowing the bathing suit to fittingly conform to the individual. The elastic based material, such as polypropylene, allows the convertible swimwear to be form-fitting to adapt to the contours on a user's body. The convertible swimwear 1 is based upon a top piece 10 and a bottom piece 20 having an intermediate portion 26. The top piece includes breast cups 11 having a top edge 13 and a lower edge 19. The breast cups are supported by an elastic based back strap 18. The back strap 18 can be continuous wherein the elastic material is stretchable in sufficient length to allow placement over the head of the individual. The strap may include a back snap 17 wherein reduced elastic band can be used, or alternatively a front snap, not shown, placed between the breast cups can be used. Similarly the straps can be tied together with a knot 36, as shown with the neck strap. Further, any combination of the continuous band with snap 17' or knot 36, or combination thereof, can be used with this invention. The top piece 10 may further include a neck strap 16 of a length allowing securement of the breast cups about the neck of the individual. The top piece 10 preferable includes a cover flap 34 extending from the lower edge 19 constructed and arranged to cover an upper edge 22 of the intermediate portion 26 when the upper edge 22 of the intermediate portion 26 is placed adjacent to the lower edge 19 of the top piece 10. The cover flap 34 is attached to the top piece 10 just below the breast cups 11. The cover flap 34 extends across the front of the top piece 10 and downwardly sufficiently to cover the upper edge 22 of the intermediate portion 26. In a preferred embodiment, the cover flap 34 only extends across the front area of the body wherein the upper edge 22 of the bottom piece 20 is higher in the front. However, in an alternative upper edge 22 of the bottom piece 20 can be equal in the front and the back wherein the cover flap 34 can extend around the body to conceal the entire upper edge 22 of the intermediate portion 26. The cover flap 34 effectively conceals the edges and is an aesthetic feature as the convertible swimwear must be pleasant to admire aside from its functional aspects.

Figure 4:
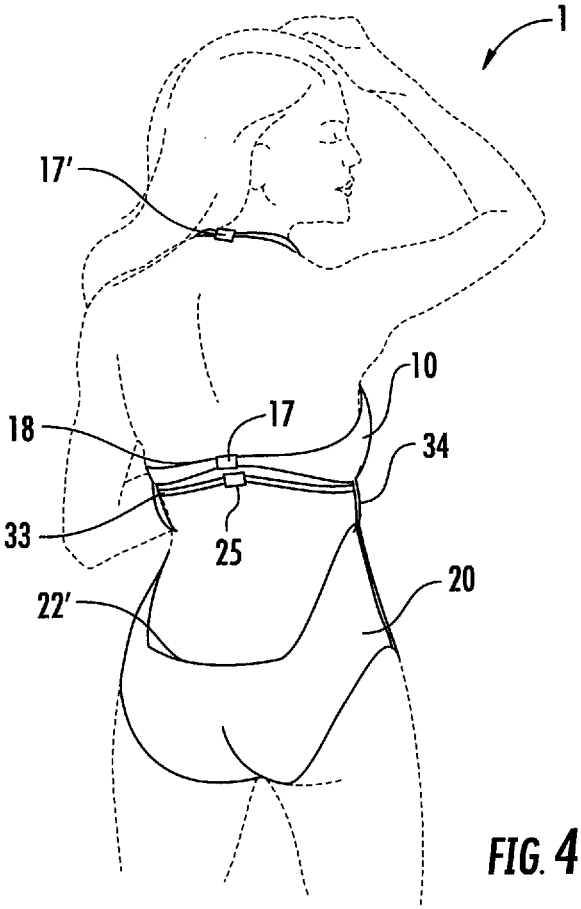
FIG. 4 is a rear view of the convertible swimwear with a low cut bottom piece.
Figure 5:
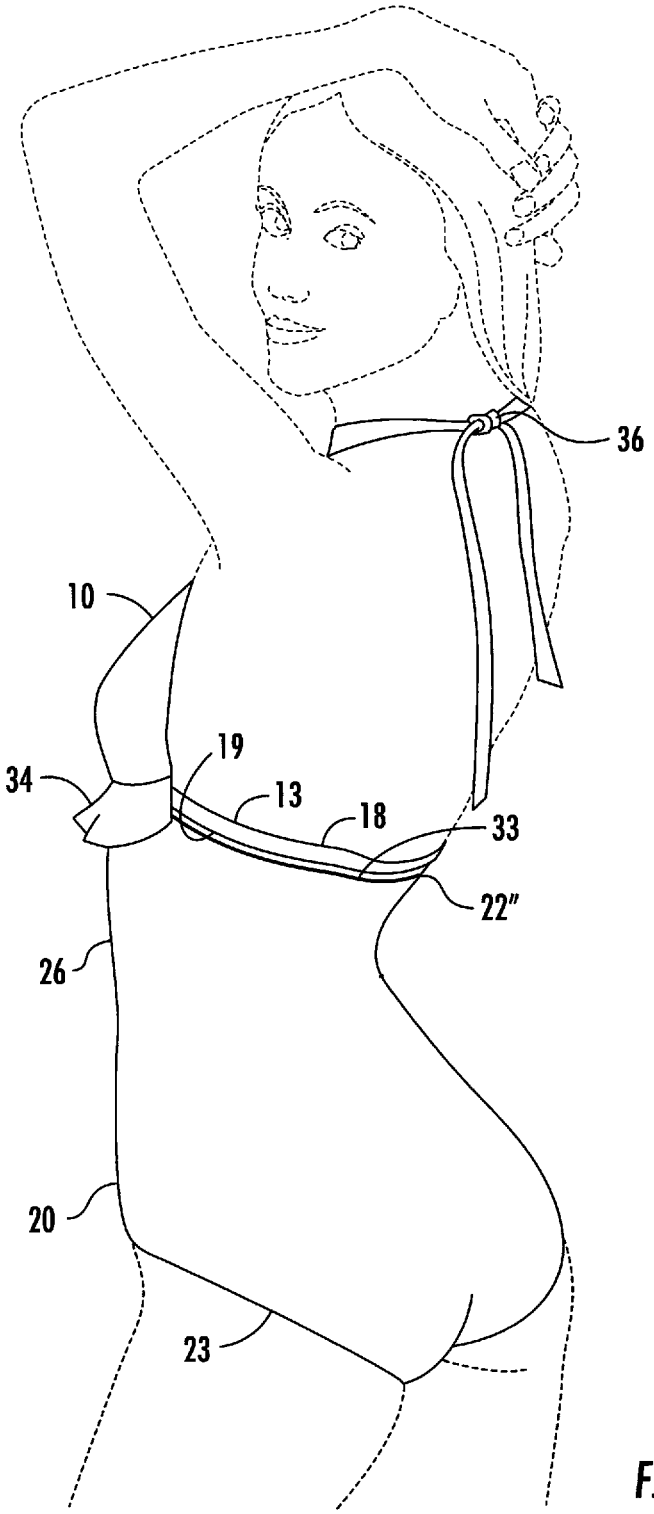
FIG. 5 is a perspective view of convertible swimwear having a snapless back straps.

The bottom piece 20 is further defined by a lower edge 24 that includes leg openings 23 with the upper edge 22 forming a body opening 21. The intermediate portion 26 is capable of covering an entire abdomen section of a wearer when the convertible swimwear is in a one piece style bathing suit. The upper edge 22" of the intermediate portion 26 is constructed and arranged to be positioned adjacent the lower edge 19 of the top piece 10 in at least the frontal area, if not both the front and back as depicted in FIG. 5, or any variation thereof. For instance, FIG. 4 depicts the rear upper edge 22' to be substantially lower than the lower edge 19 of the top piece wherein strap 33 is required to maintain the intermediate section in position. The upper edge 22 may be at any height along the back, or at any height along the front. The upper edge 22 utilizes an intermediate back strap 33 that can be continuous wherein the elastic material is stretchable in sufficient length to allow placement around the body of the individual when the back is covered as in FIG. 5. When the upper edge 22 is lower, the intermediate strap 33 may include a back snap 25 wherein a reduced elastic band can be used. Similarly the straps can be tied together with a knot 36 as shown with the neck strap 16. Further, any combination of the continuous band with snap or knot, or combination thereof, can be used with this invention.

Figure 2:
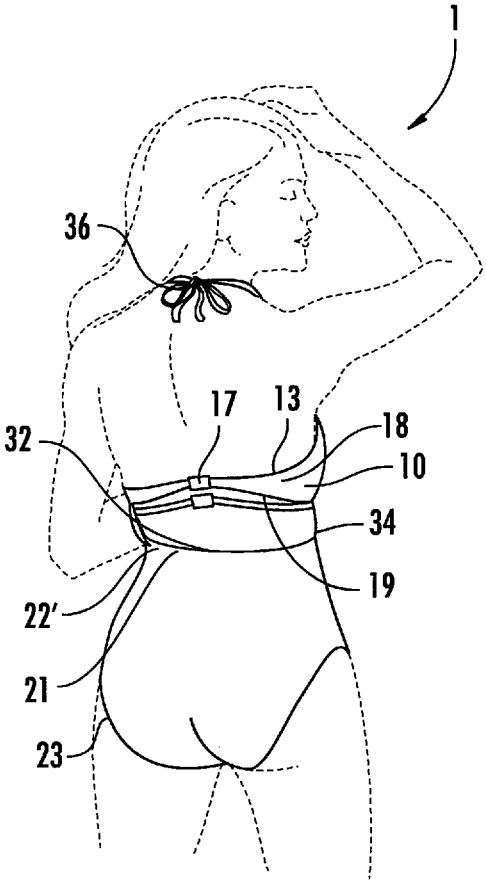
FIG. 2 is an back view of the convertible swimwear.

The intermediate portion 26 is defined as the portion of the bottom piece 20 that extends from the waist line upward. The intermediate portion 26 has a frontal upper edge 22 and a rear upper edge 22'. As previously stated the preferred embodiment employs the front upper edge 22 to extend upward to a position adjacent the top piece 10. The rear upper edge 22' can extend along any height, from a low cut shown in FIG. 4, to a mid cut shown in FIGS. 2 and 5, to a position that is equal to the front upper edge 22. Preferably the front upper edge 22 of the intermediate portion front section is of a length greater than or equal to the rear upper edge 22' of the back section.

Figure 3:
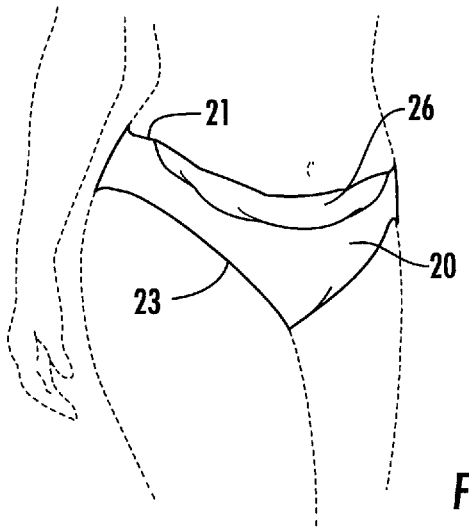
FIG. 3 is a view of the bottom piece with the intermediate section held in a scrunched position.

The bottom piece 20 is extendable from a one piece to a two piece style bathing suit wherein the use of the intermediate strap 33 can hold the intermediate portion 26 in position. The intermediate portion 26 adapts to the contours of a user's body at the abdomen and just below the top piece. In a one piece style bathing suit, the intermediate portion 26 conceals the abdomen. The bottom piece 20 may also include a full back thereby effectively covering a substantial portion of the wearer's back. The wearer can the roll, fold or scrunched up the upper edge 22 and 22' together with the intermediate portion 26 of the bottom piece 20. To scrunch the upper edge 22 relative to the intermediate portion 26 is to crunch, crumple, fold or roll. The intermediate portion 26 can then be placed within the bottom piece 20, or as shown in FIG. 3, as a scrunched roll along the body opening 21 of the bottom piece 20. Contemporaneously the intermediate strap 33 maintains the scrunched roll in position to form the two piece bathing suit. Since the elastic band is securely attached to the upper edge 22 of the intermediate portion 26, when the upper edge 22 and body of the intermediate portion 26 are scrunched together they are maintained in place. This function provides an aesthetic value as the convertible swimwear and is converted to a two piece style bathing suit.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. Convertible swimwear comprising: a top piece defined by a pair of breast cups coupled together along a first end having a top edge and a bottom edge with at least one strap extending from a second end of each breast cup having a length configured for or adapted for securement around the back of an individual; a bottom piece defined as a panty shaped bottom member having a front and a back section with two leg openings along a lower end and an elastic based form fitting intermediate front portion is permanently attached to and extending upwardly from said front section of said bottom piece extending to the bottom edge of the breast cups and an elastic based form fitting intermediate back portion is permanently attached to and extending upwardly from said back section of said bottom piece extending to the strap, said elastic based form fitting intermediate front portion and said elastic based form fitting intermediate back portion constructed and arranged to adapt to the contours of the individual for maintaining an upper edge of said intermediate portion front section adjacent said bottom edge of said top piece directly beneath said breast cups configured to cover the individual's abdomen and said elastic based form fitting intermediate back portion is configured to cover at least a portion of the individual's back to form the appearance of a one piece bathing suit wherein said upper edge of said intermediate portion front section and an upper edge of said intermediate portion back section is configured to be rolled, folded or scrunched toward said bottom piece to form the appearance of a two piece style bathing suit.

2. The convertible swimwear according to claim 1 wherein said top piece includes a neck strap having a length extending from the top edge of each said breast cup configured for securement about the neck of the individual.

3. The convertible swimwear according to claim 1 wherein said top piece includes a cover flap extending from said bottom edge beneath the breast cups constructed and arranged to cover said upper edge of said elastic based form fitting intermediate front portion when said upper edge of said elastic based form fitting intermediate front portion is placed adjacent to said bottom edge of said top piece.

4. The convertible swimwear according to claim 1 wherein the upper edge of said elastic based form fitting intermediate front portion is adjacent to the bottom edge of said top piece beneath the breast cups and the upper edge of said intermediate portion back section is spaced apart from said strap of said top piece.

5. The convertible swimwear according to claim 1 wherein the upper edge of said elastic based form fitting intermediate front portion and said elastic based form fitting intermediate back portion is spaced equally from said bottom edge of said top piece and said strap of said top piece.

6. The convertible swimwear according to claim 1 wherein said strap includes a back positioned coupling snap.

7. The convertible swimwear according to claim 1 wherein said strap includes a back positioned tie knot.

* * * * *